United States Patent [19]

Grimshaw et al.

[11] 4,352,224

[45] Oct. 5, 1982

[54] OPENING ROLLER FOR OPEN-END SPINNING APPARATUS

[75] Inventors: Keith Grimshaw, Todmorden; Roger C. Spratt, Shipley, both of England

[73] Assignee: The English Card Clothing Company Ltd., Huddersfield, England

[21] Appl. No.: 35,593

[22] Filed: May 3, 1979

[30] Foreign Application Priority Data

May 4, 1978 [GB] United Kingdom ..... 17648/78

[51] Int. Cl.[3] ..... D01G 15/14

[52] U.S. Cl. ..... 19/97; 19/112; 29/121.4

[58] Field of Search ..... 19/97, 112; 29/121.4, 29/148.4 D; 57/58.91

[56] References Cited

U.S. PATENT DOCUMENTS

| | | | |
|---|---|---|---|
| 123,589 | 2/1872 | Stearns | 19/112 |
| 2,175,131 | 10/1939 | Schwartz | 19/97 |
| 2,416,123 | 2/1947 | Siemen | 29/121.4 X |
| 2,501,629 | 3/1950 | Goulding | 29/148.40 |
| 3,968,542 | 7/1976 | Hollingsworth | 19/112 |
| 4,112,565 | 9/1978 | Sailas | 29/127 X |
| 4,296,527 | 10/1981 | Eadie | 19/97 X |
| 4,300,265 | 11/1981 | Heinen | 19/97 X |

FOREIGN PATENT DOCUMENTS

| | | | |
|---|---|---|---|
| 2803925 | 9/1978 | Fed. Rep. of Germany . | |
| 720210 | 2/1932 | France | 19/97 |
| 716930 | 10/1954 | United Kingdom | 29/148.40 |
| 854090 | 11/1960 | United Kingdom | 19/112 |
| 1502940 | 3/1978 | United Kingdom . | |

*Primary Examiner*—Louis Rimrodt
*Attorney, Agent, or Firm*—W. Thad Adams, III

[57] ABSTRACT

The invention relates to opening rollers for open-end spinning apparatus, particularly roller which comprise a body on which is wound a helical coil of metallic wire type card-clothing.

The roller body comprises two body parts secured together in end-to-end relationship, and the metallic wire type card-clothing is formed into a pre-set helical coil which is located on an external cylindrical surface of the body, the end flanks of the coil engaging respectively with two abutments one on each of the two parts of the roller body, so that the coil is constrained axially between the abutments in a manner such that adjacent convolutions of the coil are held in abutting relationship.

It is preferred to use interlocking card-clothing wire. It is also preferred to make the roller body parts in plastics material, and to secure them together by an adhesive, and in this manner a disposable roller is produced.

The specification describes methods of refurbishing existing opening rollers, in accordance with the invention.

7 Claims, 12 Drawing Figures

Figure 1:
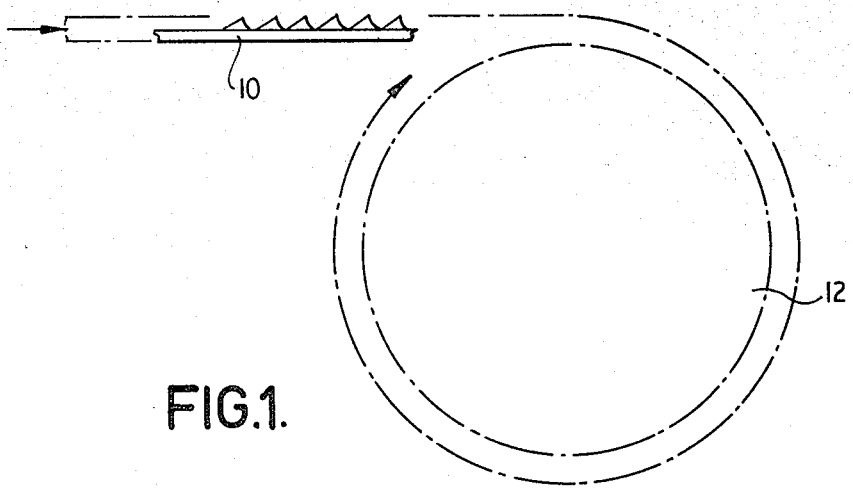

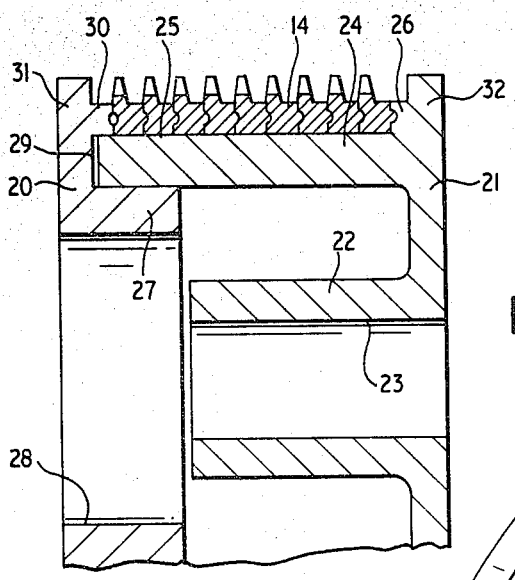
FIG.3.
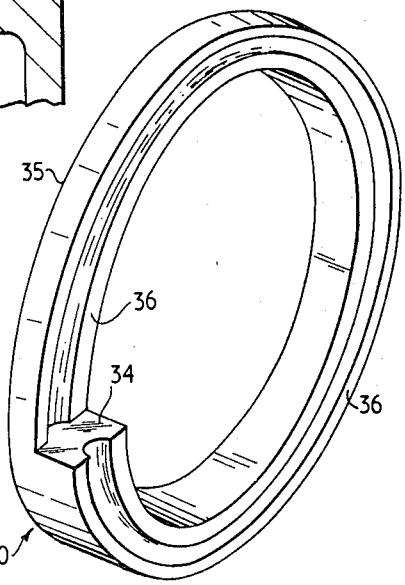
FIG.5.
FIG.4.
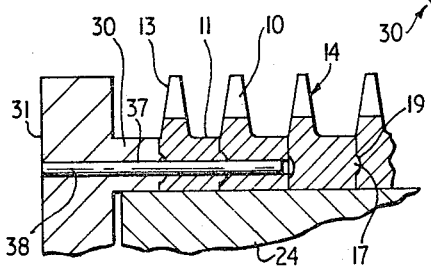

OPENING ROLLER FOR OPEN-END SPINNING APPARATUS

The opening roller of an open-end spinning apparatus is required to rotate at high speed, and the roller is mounted on a spindle which is journalled in ball or needle roller bearings. Because of the abrasive effect of the fibres, the teeth of the opening roller are subjected to comparatively rapid wear. The teeth themselves may comprise pins set into holes in the opening roller body, or metallic wire type card-clothing coiled around the roller body. In any event, when the teeth are worn, if they are to be replaced, this usually necessitates returning the roller to the manufacturer, or to a servicing agent, for re-pinning or replacement of the card-clothing, as the case may be, and this refurbishing of an open-end opening roller is relatively expensive.

An object of the invention is to provide an opening roller for open-end spinning, which is relatively cheap to manufacture, so that the roller can be regarded as disposable, and hence refurbishing is not required. Another object of the invention is to provide a convenient method of refurbishing an existing opening roller. A further object of the invention is to provide a card-clothed opening roller in which the card-clothing is securely located on the roller body.

It has been proposed (see U.S. Pat. No. 3,968,542) to manufacture a disposable card-clothed opening roller for use in an open-end spinning apparatus, by pre-setting a coil of metallic wire type card-clothing, so that the internal diameter of the pre-set coil in its unstressed state is less than that of the cylindrical surface of the roller on which the coil is received, and locating the coil on the roller so that the coil contracts on to the cylindrical surface of the roller. In order to reduce the cost of the roller and therefore to bring into the disposable category, the roller body is made in plastics material. That U.S. patent also suggests that the coil may be additionally secured to the roller by adhesive. A disadvantage of the method of construction described in U.S. Pat. No. 3,968,542 is that the coil of card-clothing wire has to be unwound to increase its internal diameter significantly to allow the coil to be threaded over a flange at one end of the roller. Another disadvantage is that the card-clothing could be dislodged radially in use under the relatively high centrifugal force set up in the roller and under the applied loads attributable to the opening action on the fibres. The present invention also employs a pre-set coil of metallic card-clothing wire, but overcomes the aforementioned disadvantages.

According to the invention, a card-clothed opening roller for use in an open-end spinning apparatus comprises two roller body parts secured together in end-to-end relationship, with at least one pre-set helical coil of metallic wire type card-clothing located radially on an external cylindrical surface of the roller body, the end flanks of the coil(s) engaging respectively with two abutments one on each of the two parts of the roller body, whereby the abutments so constrain the coil(s) axially that adjacent convolutions of the coil(s) are held in abutting relationship.

In a preferred method of carrying out the invention, the card-clothing wire is of the interlocking type and the axial constraint of the coil is such that adjacent convolutions of the coil are interlocked, whereby radial expansion of the coil is substantially prevented.

Interlocking card-clothing wire has its rib or root portion so shaped in cross-section that there is a projection on one flank and a correspondingly shaped recess on the other flank. Hence, when adjacent convolutions of the wire are closed up on each other axially, the projection seats in the recess. As a result, radial expansion of the coil is substantially prevented. Such interlocking card-clothing wire is known and has been used on the roller of carding machines, the wire being wound on to the machine roller and at the same time urged axially in the direction to cause engagement of the projection in the recess.

According to another preferred feature of the invention, which may be used with the interlocking type card-clothing wire, or with plain card-clothing wire which is not interlocked, at least one convolution at each end of the coil of card-clothing wire is pinned to the roller body to present bodily rotation of the coil on the body, and winding of one end of the coil relatively to the other end (winding up or unwinding). In one construction, a pin passes radially through the rib of the card-clothing wire at each end of the coil into the roller body. In an alternative construction, a pin passes axially through a flange at one end of the body into the rib of the card-clothing wire, and with this construction, it is preferred that at least one of the axially disposed pins passes through two or more convolutions of the coil of card-clothing wire.

The pre-set coil may be formed by winding the card-clothing wire on to a roller so that the wire is stressed in tension on the outside and in compression on the inside, the relationship between the angle through which the wire is bent and the cross-sectional shape of the wire being such that the tensile stress exceeds the elastic limit of the material from which the wire is made, so that the wire adopts a permanent "set" in the form of a coil.

Alternatively, the wire may be formed into the pre-set coil by passing it in engagement with a set of at least three rollers arranged to bend the path of the wire, this bending causing the wire to be stressed in tension on the outside and in compression on the inside, the relationship between the angle through which the wire is bent by the rollers and the cross-sectional shape of the wire being such that the tensile stress exceeds the elastic limit of the material from which the wire is made, so that the wire adopts a permanent "set".

According to another preferred feature of the invention, the two parts of the roller body are made in plastics material and they are secured together by an adhesive after the coil has been fitted on to at least one of the two parts. It has been proposed to make the unitary body of an open-end opening roller in plastics material (for example in U.S. Pat. No. 3,968,542 STYRENE is suggested). It has also been proposed to make the body of an opening roller in two parts (see for example German published Specification OFF. 28 03 925 and U.K. Pat. No. 1,502,940). However, these prior proposals do not employ the two parts of a roller body to provide axial constraint of a pre-set coil of card-clothing wire, because in each case they employ a card-clothed sleeve, which has been manufactured separately, and fitted with card-clothing, prior to its assembly on the roller body. The present invention, utilises a pre-formed coil of card-clothing, which is not mounted on to a sleeve, but instead, is mounted directly on the body of the roller. It then becomes necessary to constrain the sleeve axially, and this axial constraint is provided by the securing together of the two parts of the body. Nor has it been proposed previously to secure the two parts of a plastics opening roller body together by adhesive, a method of construction which lends itself to the production of a disposable opening roller.

Preferably, one or both parts of the roller body is manufactured by a moulding process. It is preferred to manufacture the moulded part or parts in glass filled plastics, since this material has been found to have a well controlled shrinkage, enabling the production of accurately shaped and sized parts. Furthermore, this material has a good moisture resistance, due to its non-absorbant characteristic, and hence the body maintains good dimensional stability.

The invention also includes a method of manufacturing an opening roller in accordance with the invention.

The invention is also applicable to the refurbishing of existing metal bodied opening roller, and in one such method the worn card-clothing is removed, the flange at the distal end of the roller body (if it has such a flange) is machined off and a separate ring which provides a flange is secured on the distal end of the body after a pre-set coil of card-clothing has been threaded on to the body in place of the worn card-clothing, the ends of the coil engaging respectively with the flange at the proximal end of the body and the ring, to restrain axial expansion of the coil. The ring may be secured by an adhesive and the pinning method of securing the coil may also be employed.

An alternative method of refurbishing a metal bodied opening roller, comprises the steps of: removing the worn clothing; reducing the outside diameter of the roller body to a diameter less than that of the internal diameter of the card-clothing on the original opening roller; providing two roller body parts each of which is bored to fit on the reduced diameter of the body and which together are adapted to form an effective outer portion of the roller body when positioned on the said reduced diameter portion and which together also provide a cylindrical portion to receive a coil of card-clothing wire; pre-setting a coil of metallic wire type card-clothing to a bore size approximating to that of said cylindrical portion; threading the coil of card-clothing wire on to at least one of the two roller body parts and engaging one end of the coil with an abutment on that roller part; engaging the opposite end of the coil with an abutment on the other roller body part; bringing the two roller body parts towards each other to compress the coil so that adjacent convolutions are in abutting relationship; winding the coil to ensure radial location of the coil on the said cylindrical portion of the roller body, and securing the two parts of the body to the reduced diameter of the roller body and/or to each other to maintain axial constraint in the coil of card-clothing wire.

Figure 2:
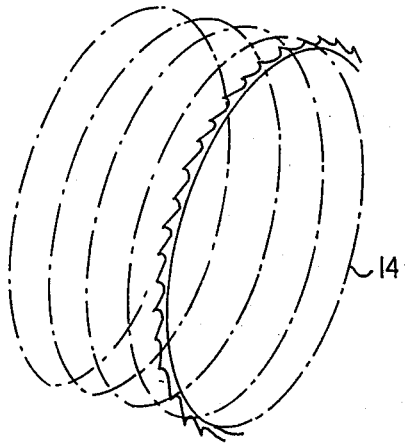
Figure 6:
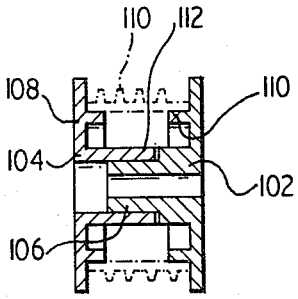
Figure 7:
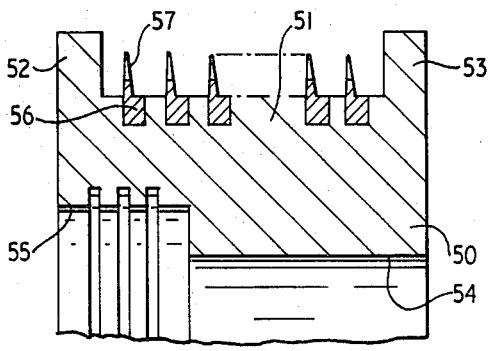
Figure 8:
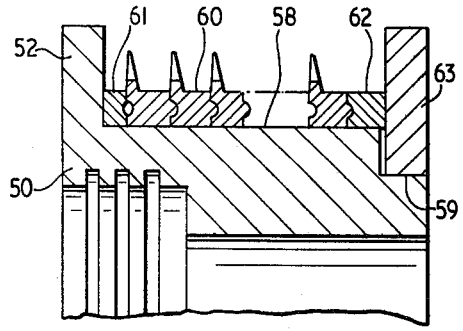
Figure 9:
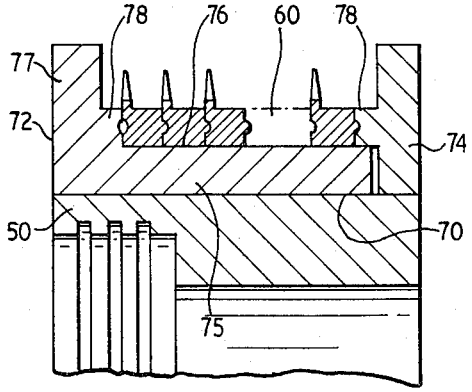
Figure 10:
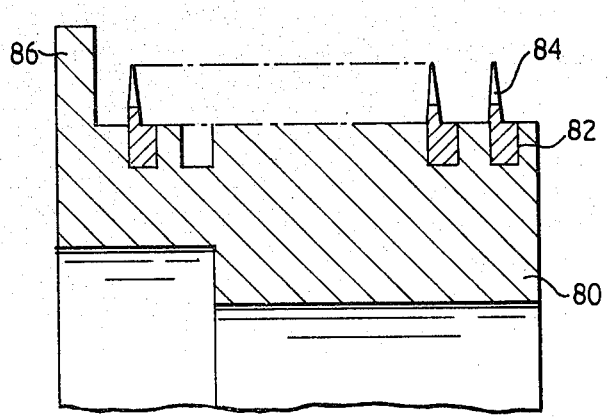
Figure 11:
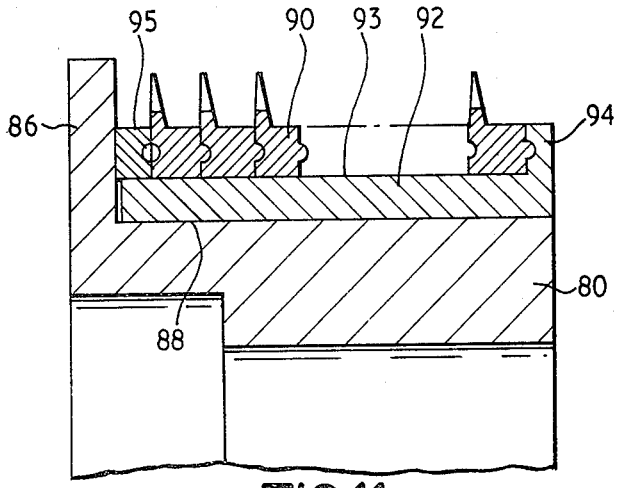
Figure 12:
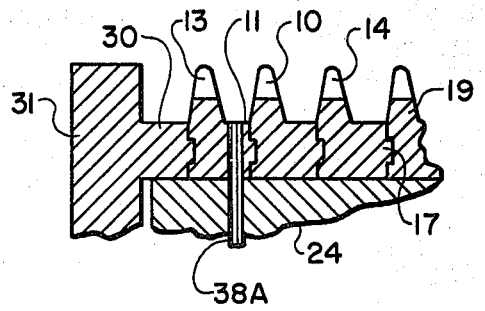

Several forms of the invention will now be described by way of examples only, with reference to the accompanying drawings, in which:

FIG. 1 illustrates a method of pre-stressing metallic wire type card-clothing, FIG. 2 is a perspective view of a pre-set coil of card-clothing wire made by the method shown in FIG. 1, FIG. 3 is a section through an opening roller constructed in accordance with the invention, FIG. 4 is an enlarged detail view of part of the opening roller shown in FIG. 3, showing an optional feature, FIG. 5 is a perspective view of a filling washer employed in the construction of the opening roller shown in FIG. 3, FIG. 6 is a section through an alternative design of opening roller, FIG. 7 is a section through an existing metal bodied opening roller, FIG. 8 is a section through the opening roller, showing a method of refurbishing the roller, FIG. 9 illustrates another method of refurbishing the existing metal bodied opening roller shown in FIG. 7, FIG. 10 is a section through an alternative design of existing metal bodied opening roller, FIG. 11 shows a method of refurbishing the roller shown in FIG. 10, FIG. 12 is an enlarged detail view of part of the opening roller shown in FIG. 3, showing a radially extending securing pin.

As a preliminary to the manufacture either of the opening rollers shown in FIGS. 3 and 6, or to refurbishing a roller as shown in FIGS. 8, 9 and 11, it is necessary to form a pre-set coil of card-clothing. The coil is made entirely from interlocking metallic wire type card-clothing 10, a typical cross-section of which is illustrated clearly in FIG. 4. The wire has a rib 11 and a tooth portion 13, in which teeth are formed so that the wire has the appearance of a thin saw blade. Metallic wire type card-clothing is well known, and it is not necessary to describe it in detail.

The particular card-clothing wire used is of a special interlocking type. Interlocking wire is known in which the whole of the rib portion is of so-called V-section, the V being turned on its side, so that the rib forms a projecting nose (as seen in cross-section) at one side and a is of a somewhat different design in that the projection 17 at one side of the rib of the wire is relatively small in cross-section (the recess 19 on the other side being correspondingly shaped).

The wire is formed with its teeth in known manner, before the pre-stressing process which will now be described. In the pre-stressing process, one end of the wire 10 is anchored to a roller 12 (see FIG. 1) of relatively small diameter, with the teeth of the wire pointing outwardly and then that roller is rotated, and at the same time, the supply of wire 10 being fed to the roller is traversed axially of the roller, so that the wire becomes coiled helically on to the roller. The geometry of the winding arrangement is such that the bending of the wire as it is wound on to the roller 12, causes the tensile stress set up in the outside of the wire to exceed the elastic limit of the wire, and hence the wire adopts a permanent "set" in the helically coiled condition. After this winding-on operation has been completed, the wire is disconnected from the roller 12, and withdrawn from that roller in the form of a coil 14. The coil is illustrated in FIG. 2, and any spring in the wire will cause the convolutions to expand somewhat axially, so that the coil will to some extent be opened out. However, the pre-setting of the wire is arranged to produce a coil with an internal diameter approximating to that of the cylindrical surface of the roller body on which the coil is to be received.

As an alternative to bending the wire by winding it on to a roller the wire may be bent by passing it in engagement with a set of three or more rollers which are so arranged that they cause the wire to issue from their nip in the form of a coil.

The opening roller body (see FIG. 3) comprises two parts 20 and 21, each of which is made as a moulding in glass filled plastics material. One of the characteristics of this material, is that it has well controlled shrinkage, which enables the moulding of an accurate shape. Another characteristic of the material, is that it has good moisture resistance due to its non-absorbant nature, and this gives the roller good dimensional stability.

The distal part 21 of the roller body is formed with a relatively small diameter central boss 22, which is bored at 23, for fitting on to the spindle (not shown) of the spinning apparatus. A larger annular member 24 is concentric with the bore 23, and projects further from the end portion of the part 21 than the central boss 22. The member 24 provides an external cylindrical surface 24, which receives the card-clothing coil 14 as hereinafter described in greater detail. An annular abutment element 26 is formed integral with the part 21, in the corner between the external surface 25 of the member 24, and the inside face of an end flange 32 formed on the part 21.

The proximal part 20 of the roller body is formed with a boss 27 bored at 28, to receive the usual bearing housing provided on the spindle of the spinning apparatus and also has a flange 31. The member 24 of the part 21 is a close fit on the outside of the boss 27, and as illustrated in FIG. 3, the proximal end of the member 24 is received in an annular recess 29 formed in the part 20, between the boss 27, and an annular abutment element 30 similar to the abutment element 26 on the part 21. The element 30 is a close fit on the external cylindrical surface 25 of the member 24, so that when the two parts of the roller body are pressed together as indicated in FIG. 3, the proximal end of the member 24 is snugly located in the recess 29.

The inner faces of the abutment elements 26 and 30, have a special formation, which will be hereinafter described.

When the roller is assembled, the coil of card-clothing wire 14 is mounted on the cylindrical surface 25 of the member 24 of the roller body, and the coil 14 is compressed axially, so that adjacent convolutions of the wire engage with each other, the interlocking projection 17 of each convolution engaging in the interlocking groove 19 of an adjacent convolution, this being illustrated in FIG. 4. In this manner, a complete cylindrical sleeve of the metallic wire type card-clothing is formed, and by winding up the coil on itself if necessary, it is possible to ensure that the inside diameter of the sleeve is such that it is a tight fit on the cylindrical periphery 25 of the roller body. It will be appreciated however, that at each end of the card-clothing coil, the end flank of the coil is not in a plane perpendicular to the longitudinal axis of the roller, but is in a helical plane arising out of the coil formation.

One of the drawbacks of some known card-clothed open-end spinning opening rollers, is that there is a recess between the end of the card-clothing coil and the flange on the roller body, and in that case there is frequently a build-up of fibrous material in this gap, which is detrimental to the opening action of the roller. Moreover, in the present construction, the two parts 20 and 21 of the roller body, are used to provide axial constraint on the card-clothing coil (i.e. they hold the coil in a compressed condition), with all the convolutions abutting each other, and with the projection 17 interlocked in the recess 19. If the inside faces of the abutment elements 26 and 30 were in planes perpendicular to the axis of the roller, then those abutments could only engage with the ends of the coil very close to the extremities of the coil. Hence, there would be a tendency for the entire coil to adopt an inclined attitude relatively to the roller body, and the constraining force applied to the two parts of the roller body would be unevenly distributed through the coil.

It is for these reasons, that each of the abutment elements, has a special inner face, the construction of which is illustrated in FIG. 5. Only the element 30 is illustrated in FIG. 5, but it will be appreciated that the element 26 has a similar shape. The inner end face 36 of the abutment element, is formed in a helical plane complementary to the helical plane of the flank of the end convolution of the card-clothing coil (i.e. it has the same helical pitch as the coil) when the coil is in the compressed condition. A step 34 is formed at the junction between the thinnest and thickest parts of the element 30.

When the compressed coil of card-clothing is fitted on to the member 24 of the roller body, one extremity of the coil is brought into engagement with the step 34, and the exposed flank of the end convolution of the coil will then fit snugly against the helical inner end face 36, so that there is no gap between the card-clothing coil and the flange 31 at that end of the roller body. Hence, the fibre trap which is commonly found in card-clothing opening roller is eliminated.

It is to be understood, that instead of the abutment elements 26 and 30 being moulded integral with their respective roller body parts 21 and 20, they could be formed as separate ring-like distance pieces, in which case each would have an end face, indicated at 35 in FIG. 5, in a plane perpendicular to the axis of the distance piece, for engagement with the flange 31 or 32 of the roller body.

In order to assemble the opening roller shown in FIG. 3, one end of the still opened-out coil 14 of card-clothing wire, is threaded on to the member 24, and the extremity of that end of the coil is engaged with the step 34 on the abutment element 26. The coil is then compressed axially towards the flange 32 of the body part 21 and a film of adhesive is applied to the mating portions of the two body parts 20 and 21. The two parts 20 and 21 are then pressed axially towards each other, and at the same time, the part 20 is rotated relatively to the part 21, until the step 34 on its abutment element 20 is in engagement with the other extremity of the card-clothing coil 14.

When the adhesive has set, the two parts 20 and 21 are bonded together, thus forming a complete roller body, which for practical purposes, is identical to a conventional metal roller body. The flanges 31 and 32 perform the function of containing the coil 14 of card-clothing wire axially in the form of a closed-up sleeve, and due to the interlocking action of the wire, radial expansion of the coil is automatically prevented. In this way, the card-clothing is very accurately and effectively located on the roller body. The card-clothing is well adapted to stand up to relatively heavy applied loads, without any shifting of its position on the roller body. Moreover, there are no end recesses, in which fibrous material can lodge. Hence, a very effective opening roller is produced by this method of manufacture, and since the roller body is relatively cheap to manufacture, once the card-clothing on it becomes badly worn, it is possible to treat the entire roller as disposable.

Supposing that the abutment elements 26 and 30 are made as separate ring-like distance pieces, then it will be appreciated, that the distance piece 26 has to be threaded on to the member 24, before the coil 14 is applied to the member 24, and it is also necessary to press the distance piece 30 into the other end of the coil and then locate that distance piece on the proximal end of the member 24, before the two parts 20 and 21 of the roller body can be brought together.

In an alternative method of construction, which is not illustrated, the abutment elements are not provided on the roller body parts 20 and 21. The coil 14 is simply allowed to take up a position between the end flanges 31 and 32, and then when the adhesive has set, so that the body is complete, a plastics material is poured into the recesses left and the ends of the coil, between those ends and the inside faces of the flanges 31 and 32, and this adhesive is allowed to fill up the end spaces and then to set. In this way, effective abutment elements are moulded on the otherwise completed opening roller.

Referring now to FIG. 4, there is shown a modification, in which after assembly of the roller shown in FIG. 3, a fine hole 37 is drilled axially through the flange 31, the abutment element 30 and two convolutions of the coil 14. A hardened steel pin 38 is then driven into the hole, and this pin has the effect of ensuring that there is no bodily rotation of the card-clothing coil relatively to the roller body. Alternatively, a pin can be passed radially through the root portion 11 convolution 14 and into member 24, as is shown in FIG. 12. In practice, it may not be necessary to use such a pin, since the frictional grip of the card-clothing coil on the member 24 may be sufficient to prevent any such relative rotation. However, if problems of rotation of the card-clothing coil arise, then a pin such as that illustrated in FIG. 4, can be used to prevent it. It will be appreciated, that a similar pin is provided at the distal end of the roller, and it will also be appreciated, that it is not essential for the pin to penetrate two convolutions of the card-clothing, although it is preferred to do so.

Incidentally, if the pinning method is used, then it is not essential to use interlocking card-clothing wire, because the pins will prevent relative radial motion of the convolutions of the coil, once the coil has been positioned on the roller body.

FIG. 6 shows an alternative construction, which employs a pre-set coil of interlocking card-clothing wire 100, formed in exactly the same manner as described above with reference to FIGS. 1 and 2. However, in this construction, the roller body comprises a proximal part 104 and a distal part 102, and in this construction the card-clothing sleeve 100 is supported between annular ribs 108 and 110 formed respectively on the flanges of the parts 104 and 102. It will also be noted, that the part 102 has a boss 106, which enters a bore formed in a boss 112 of the part 104. The outer end of the boss 112 engages with a shoulder formed on the part 102, and adhesive is applied to the end of the boss 112 and the shoulder on the part 102 as well as to the outside surface of the boss 106 and the bore of the boss 112, for the purpose of securing the two parts 102 and 104 together in the assembled condition.

Essentially, the opening roller illustrated in FIG. 6 is assembled in the same manner as that shown in FIG. 3, but in this construction, only the end portions of the coil of card-clothing are located radially on the bosses 108 and 110. Clearly however, if the end portions of the coil are radially located, and the coil cannot move axially or radially, due to the axial compression between the flanges of the two body parts and its own interlocking action, it is not necessary to support the centre portion of the coil between the bosses 108 and 110.

The invention is also applicable to the refurbishing of existing metal-bodied opening rollers, one of which is shown in FIG. 7. In such a roller, the body 50 is made in aluminium or aluminium alloy, and has a cylindrical portion 51 with proximal and distal end flanges 52 and 53, a bore 54 and a counter-bore 55. The cylindrical portion 51 is formed with a helical groove 56 in which is fitted the rib portion of a coil of metallic wire type card-clothing. The card-clothing 57 is fitted into the groove 56 of this conventional type of roller, by winding the card-clothing wire directly into the groove, so that the wire is not pre-set into the form of a coil. The ends of the metallic wire type card-clothing are secured to the body 50 by swaging.

When the card-clothing 57 becomes worn, it is necessary to return the opening roller to the manufacturer or servicing agency, who removes the card-clothing wire and refits fresh wire into the groove 56. This is a time consuming and expensive operation, and because the rollers have to be returned to the manufacturer or servicing agency the user has to keep a stock of newly clothed rollers as replacements for any which have been returned.

For purposes of re-clothing a roller as shown in FIG. 7, in accordance with the present invention, the card-clothing wire is removed, and the roller body 50 is then turned to remove the distal flange 53, and the portion of the body between the helical groove 56, so that a fresh cylindrical periphery 58 (see FIG. 8) is formed on the body 50, the diameter of this periphery 58, being the same as the roots of the groove 56 if the replacement wire is of the same height as the wire which is being replaced, or a smaller diameter if the replacement wire is of greater height than the wire which is being replaced. Further, the distal end of the roller is recessed as shown in 59 to a diameter smaller than that of the periphery 58.

A pre-set coil of interlocking card-clothing wire 60 is provided, similar to the coil 14 previously described. Also, distance pieces 61 and 62 similar to the abutment elements 26 and 30 are provided, for the purpose of producing end faces perpendicular to the roller axis on the coil 60.

A separate end flange 63 is provided and this takes the form of a ring which can be fitted snugly into the recess turned at the distal end of the body 50, the ring providing a replacement for the flange 53, when in this position on the roller body. The ring 63 may be made of aluminium or aluminium alloy, or alternatively it may be made as a plastics moulding, in the glass filled plastics material previously referred to.

After the body 50 has been turned, the distance piece 61 is first threaded on to the cylindrical portion of the body 50, and this is followed by the proximal end of the coil 60, which at that stage is still in the axially opened condition. The coil is compressed manually on to the cylindrical portion of the body, and the distance piece 62 is also threaded on to that cylindrical portion. Finally, the ring 63 is pressed into position and secured by adhesive to the body 50. Before the adhesive has set the axial compression applied between the flange 52 and the ring 63 causes the adjacent convolutions of the coil 60 to be interlocked with each other as in the case of the roller illustrated in FIG. 3.

The result is a card-clothing opening roller, which for operational purposes is identical with the original roller shown in FIG. 7. Subsequent refurbishing is so simple that it may be carried out at the works of the user. If the card-clothing 60 becomes worn, the ring 63 is forced off the roller body 50, so that the coil 60 is released. A fresh coil 60 can then be placed on the body 50, and the ring 63 replaced and bonded to the body. It will be appreciated that in this construction, the two-part roller body is constituted as to one part by the major portion of the body 50 left after the turning operation, and as to the other part, by the ring 63 which is provided as a separate element.

Turning now to FIG. 9, there is illustrated another method of refurbishing a roller of the type shown in FIG. 7. In this method, when the card-clothing 57 becomes worn, the entire outer portion of the roller body 50 is turned away, leaving a cylindrical periphery 70 of somewhat smaller diameter, than the diameter of the roots of the grooves 56. Two moulded plastics ring elements 72 and 74 are provided, the element 72 having an extended boss 75 formed with a cylindrical periphery 76 of the same diameter as the roots of the grooves 56 and the element 74 having a recess to receive the boss 75. Each ring element also has an end flange 77 and an abutment element 78 in the angle between the periphery 76 and the end flange. This abutment element is formed with a helical surface and step on its inside face, in similar fashion to the abutment elements 26 and 30 previously described, so that the extremity of a coil of card-clothing wire can be engaged with the step, and the flank of the end convolution with the helical surface of the abutment element. Thus, in this construction, instead of having separate distance pieces, they are made integral with the ring elements 72 and 74. It will be appreciated that separate distance pieces could be used in this construction.

It will be appreciated that with this method of refurbishing, it is necessary to bond the ring elements 72 and 74 to the turned down body 50 by means of an adhesive and in addition adhesive may be used on the mating end faces of the elements 72 and 74, for the purpose of holding those elements together and providing the necessary axial compression of the coil of card-clothing which is fitted between the abutment elements 78.

FIG. 10 illustrates another known type of card-clothing opening roller, in which there is a metal body 80 formed with a helical groove 82 to receive the card-clothing wire 84. A flange 86 is formed at the proximal end of the body 80, but unlike the previously described construction, there is no flange at the distal end. The method of refurbishing this known type of roller is illustrated in FIG. 11, and results in a roller which is effectively of the same dimensions as the original roller. When the card-clothing 84 is worn, the body 80 is turned to provide a cylindrical periphery 88, of somewhat smaller diameter than the diameter of the root of the groove 82 in the original roller. A pre-set coil of interlocking card-clothing wire 90 is employed, but in this method, there is also provided a moulded plastics sleeve 92, which is bonded by adhesive on to the periphery 88, and which itself has a cylindrical periphery 93 the same diameter as the root of the helical groove in the original roller. In addition, the sleeve 92 is formed with an end flange 94 the inside face of which has the helical and stepped formation of the abutment elements previously described. A distance piece ring 95 of the type previously described is also fitted on the sleeve 92 at the opposite end to the flange 94.

With this method, the pre-set coil 90 of card-clothing is threaded on to the sleeve 92 and the outer extremity and outer convolution of the coil are engaged with the formation on the inside of the flange 94. The distance piece 95 is then pressed on to the end of the sleeve. At this stage, the sleeve 92 is pressed on to the periphery 88 of the body 80 (this periphery having been coated with adhesive) and the sleeve is pressed towards the flange 86 at the proximal end of the body 80 in order to apply the necessary axial compressive force to the coil 90 to ensure interlocking of the convolutions of that coil. In this arrangement, the two parts of the roller body are (i) the turned down body 80, and (ii) the sleeve 92 with its flange 94.

Although in all the examples described above, adhesive is used to secure the two parts of the roller body together, it is to be understood that screws or other mechanical fastenings could be employed instead of or in addition to the adhesive. It is also to be understood, that certain features of the refurbishing methods illustrated in any one of FIGS. 8, 9 and 11, could be interchanged. Furthermore, it is to be understood that instead of using interlocking wire as a means of refurbishing, plain ribbed metallic wire type card-clothing could be used, but in that case, it is preferred to use a pinning method similar to that illustrated in FIG. 4. It is also to be understood, that instead of using axially directed pins as illustrated in FIG. 4, it is possible to secure the ends of the coil 14 to the roller body, by radially directed pins driven through the rib 11 of the card-clothing, into the body.

In all the examples described above it has been assumed that there is only a single coil of card-clothing wire. However it would be possible to use two or more coils each formed by the method described with reference to FIGS. 1 and 2 on a single roller, so that a convolution of one coil is located axially between adjacent convolutions of the other coil or coils. The convolutions of the coils are then interdigitated but it is still possible to compress the coils so that the flanks of each convolution engage with flanks of adjacent coils.

We claim:

1. An improved card clothed opening roller for use in an open-end spinning apparatus and comprising two roller body parts, each having an inwardly facing abutment and being secured together against axial separation in a closed position, at least one pre-set helical coil of metallic wire type card-clothing located radially on an external cylindrical surface provided by said two roller body parts in the closed position, the end flanks of said coil(s) engaging respectively with said two abutments, the improvement wherein said abutments so constrain said coil(s) axially that adjacent convolutions of said coil(s) are brought into compressive abutting relationship, whereby the axial length of the coil determines the axial length of said roller in the closed position.

2. A card-clothed opening roller as claimed in claim 1, wherein said card-clothing wire is of the interlocking type and the axial constraint of said coil is such that adjacent convolutions of said coil are interlocked, whereby radial expansion of said coil is substantially prevented.

3. A card-clothed opening roller as claimed in claim 1, wherein at least one convolution at each end of said coil(s) of card-clothing wire is pinned to said roller body to prevent rotation of said coil(s) on said body, and winding of one end of said coil(s) relatively to the other end (winding up or unwinding).

4. A card-clothed opening roller as claimed in claim 3, in which a pin passes radially through the rib of said card-clothing wire at each end of said coil(s) into said roller body.

5. A card-clothed opening roller as claimed in claim 3, in which a pin passes axially through a flange at each end of said body into the rib of said card-clothing.

6. A card-clothed opening roller as claimed in claim 5, in which at least one of the axially disposed pins passes through at least two convolutions of said coil(s) of card-clothing wire.

7. A card-clothed opening roller as claimed in claim 1, wherein said two parts of the roller body are made in plastics material and they are secured together by an adhesive after said coil(s) has been fitted on to at least one of said two parts.

* * * * *